United States Patent [19]

Westimayer

[11] 4,409,748

[45] Oct. 18, 1983

[54] SNOWBLOWER HYDRAULIC CHUTE ROTATION ASSEMBLY

[75] Inventor: David A. Westimayer, Horicon, Wis.

[73] Assignee: Deere & Company, Moline, Ill.

[21] Appl. No.: 427,393

[22] Filed: Sep. 29, 1982

[51] Int. Cl.[3] ..... E01H 5/09

[52] U.S. Cl. ..... 37/261; 193/22; 285/272; 74/89.22

[58] Field of Search ..... 37/261; 193/2 A, 22, 193/4; 285/272; 74/89.22

[56] References Cited

U.S. PATENT DOCUMENTS

| | | | |
|---|---|---|---|
| 497,706 | 5/1893 | Chase | 74/89.22 |
| 2,859,629 | 11/1958 | Parker et al. | 74/89.22 |
| 3,273,408 | 9/1966 | Nagel et al. | 74/89.22 X |
| 3,509,977 | 5/1970 | Bacon | 37/261 X |
| 3,570,641 | 3/1971 | Lefeuvre et al. | 192/22 X |
| 3,726,029 | 4/1973 | Deen et al. | 37/261 |
| 3,780,455 | 12/1973 | Stevenson | 37/261 |
| 4,158,923 | 6/1979 | Steiner et al. | 37/261 |

*Primary Examiner*—E. H. Eickholt

[57] ABSTRACT

The rotation assembly is comprised of a frame structure having a top surface. A longitudinal slot is formed along the top surface extending therethrough. A first pulley and second pulley are rotatably mounted to the top surface of the frame such that the slot is generally therebetween. A hydraulic cylinder is fixably mounted to the frame and has a pin extending through the cylinder arm of the hydraulic cylinder and the slot. Rotatably mounted on the pin atop the frame surface is a third pulley, such that activation of the cylinder arm causes the third pulley to travel along a path defined by the slot. The frame is fixably mounted to the rear of the snowblower housing. A first and second cable is fixably attached at one end to the side of the snowblower chute. The cables are looped around the pulleys in such a manner that activation of the cylinder causes the relative length of the cables with respect to the pulleys to vary, resulting in the rotation of the snowblower chute.

5 Claims, 4 Drawing Figures

SNOWBLOWER HYDRAULIC CHUTE ROTATION ASSEMBLY

BACKGROUND OF THE INVENTION

This invention relates to snowblowers, and more particularly to means of adjusting the snowblower's chute direction.

There are a variety of means, some mechanical and some hydraulic, for rotating the discharge chute of a snowblower. Of those means, which are hydraulic, a rather substantial size hydraulic cylinder must be used to derive sufficient cylinder rode travel to achieve adequate chute rotation. It would be beneficial to derive a method or assembly which would reduce the necessary cylinder size such that the chute rotation assembly can be more compact, and thus offer the opportunity for better shielding of the chute rotation assembly from possible damage by the environment.

SUMMARY OF THE INVENTION

A snowblower hydraulic chute rotation assembly includes a frame fixably mounted to the rear section of the snowblower housing. The frame has a top surface which has a longitudinally extending slot. A plurality of pulleys are rotatably mounted to the top surface locating the slot generally therebetween. A hydraulic cylinder is fixably mounted to the frame beneath the frame's top surface. A pin extends through the arm of the hydraulic cylinder and the slot. Rotatably mounted to the pin atop of the slot is a third pulley. The cylinder is aligned such that movement of the cylinder arm causes the third pulley to travel in a path defined by the slot. A cable has respective ends fixably mounted to different sides of a chute rotatably mounted on the snowblower. The cable is looped around the pulleys in such a manner that displacement of the third pulley alters the relatively length of the cable with respect to the pulleys to cause the chute to rotate. It is appreciated that by increasing the number of loops around each pulley, the response sensitivity, that is the degree of rotation per unit of displacement of the third pulley, is increased.

In the alternative, the hydraulic cylinder is mounted to the frame at one end and has a brace structure fixably mounted to the hydraulic cylinder arm. The brace structure rotatably carries a plurality of pulleys. A second brace is fixably mounted to the frame and has a third pulley rotatably mounted thereto. A guide means is formed on the second brace to allow the first place to slidably move therein. A cable is fixably mounted to opposite sides of the chute and looped around the pulleys in such a manner that displacement of the hydraulic cylinder arm causes the first brace mounted pulleys to displace relative to the pulley mounted on the second brace. The change in the relative lengths of cable between the pulleys causes the chute to rotate. Again, the number of loops around the pulleys affects the response sensitivity of the chute to displacement of the hydraulic cylinder.

It is therefore an objective of the present invention to present a relatively compact hydraulic clutch rotation system with improved chute response characteristics.

DESCRIPTION OF THE PREFERRED EMBODIMENT

Figure 1:
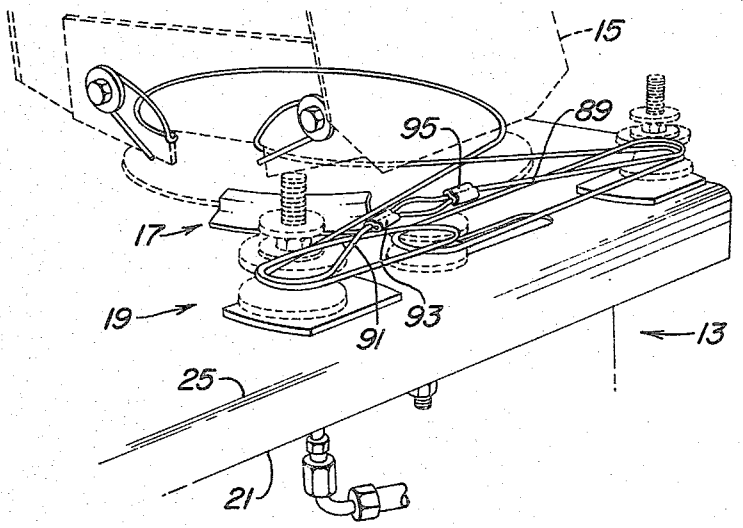
FIG. 1 is a partial prospective view of a snowblower housing and chute rotation system im compliance with the present invention.

Referring to FIG. 1, a snowblower includes a housing having a rear portion 13. The snowblower housing contains a scraper and impeller rotatably mounted therein (not shown), the impeller being located within the rear portion 13. A discharge chute 15 is rotatably mounted atop the housing rear portion 13 by any conventional manner such as by sleeves or braces 17. A hydraulic clutch assembly, generally indicated as 19, is fixably mounted by any conventional means to the housing gear portion 14 and is in communication with the discharge chute 15 in a manner to be described subsequently.

Figure 2:
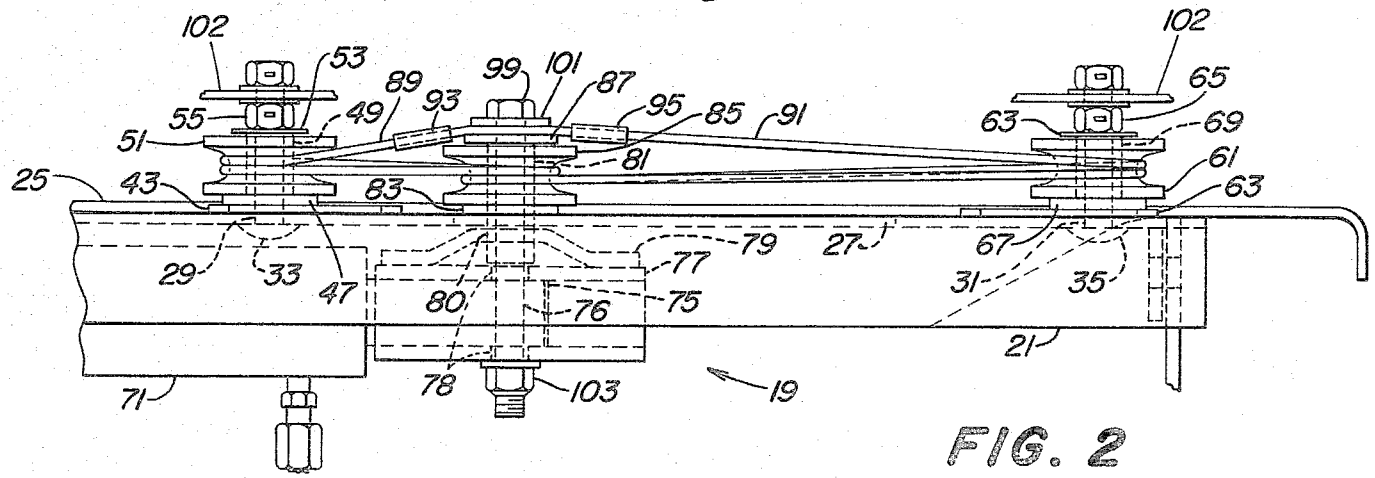
FIG. 2 is an elevated view of the chute rotation system.
Figure 3:
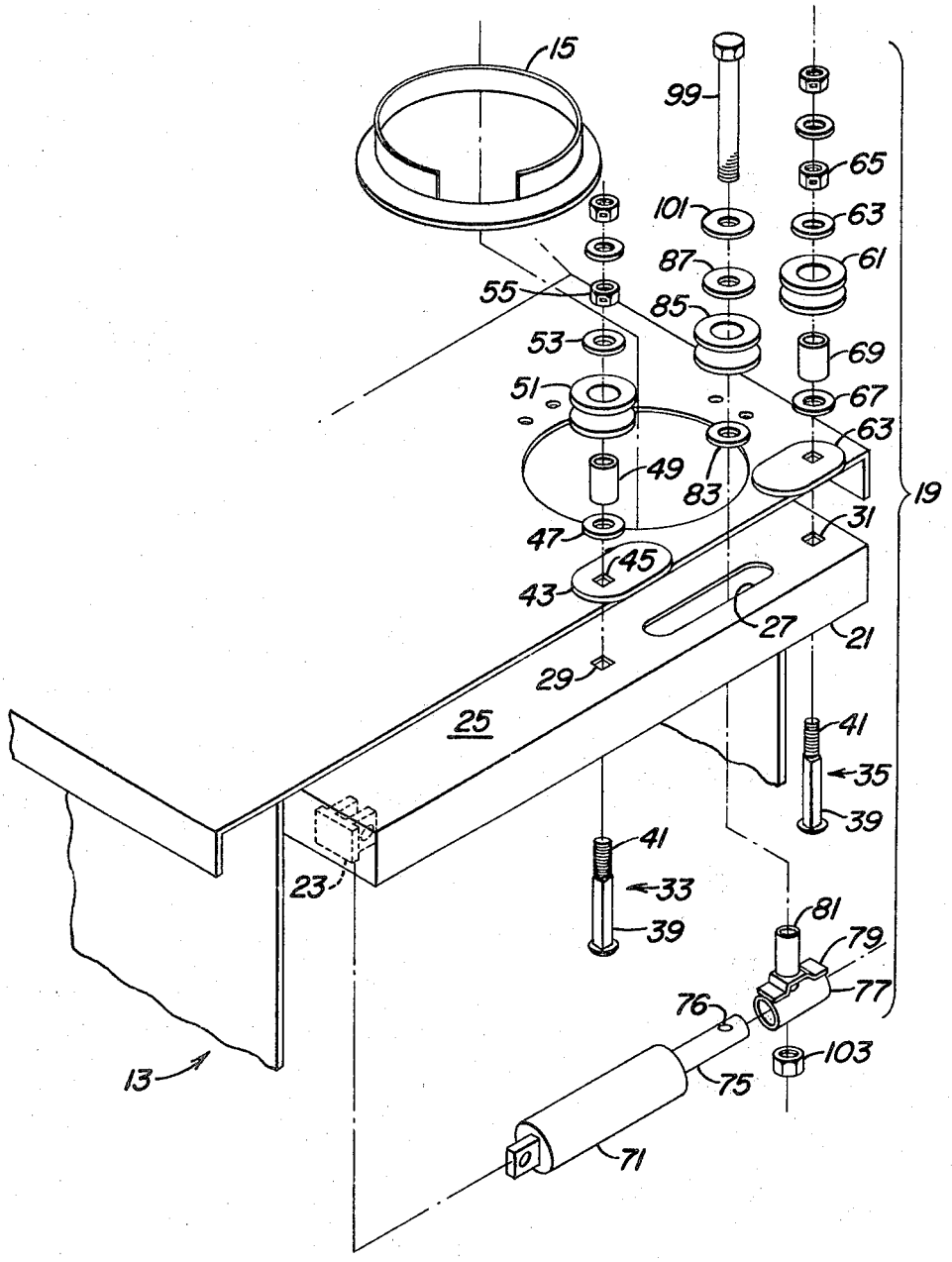
FIG. 3 is a partial exploded view of the chute rotation system.

Referring more particularly to FIGS. 2 and 3, the hydraulic clutch rotation assembly 19 is comprised of a frame 21 having a mounting member 23 fixably mounted thereto by any convention means at one end. Frame 21 has a top surface 25 containing a longitudinal slot 27. Holes 29 and 31 extend through the surface 25 locating a generally longitudinal slot 27 generally between the holes 29 and 31. A bolt 33 and 35 is passed through respective holes 29 and 31. The holes 39 and 31 have a generally square configuration. Each bolt 33 and 35 has a elongated stem section 39 which has a matingly square configuration leading therefrom to a threaded stem section 41. The bolt section 39 is matingly received in the respective hole 29 and 31 to restrain rotational motion of the respective bolt 33 and 35.

Bolt 33 has placed around a portion of section 39 a pulley support 43 having a mating square opening 45. The pulley support 43 is rest atop the frame surface 25 such that the head of the bolt 33 and the pulley support 43 sandwiches a portion of the frame surface 25 therebetween. A washer 37 is placed around the bolt section 39 following the pulley support 43. Following the washer 47 around bolt section 39 is a spacer 49 having a mating longitudinal center opening to section 39. A pulley 51 is then placed around the spacer 49 to be rotatable thereabout. A washer 53 and nut 55 are placed around the bolt 33 stem section 41 such that the nut 55 is in threaded engagement with the stem section 41. In like manner, bolt 35 has a pulley support member 63 followed by a washer 67 and a spacer 69. A pulley 61 is placed around the spacer 69 and thereafter followed by a washer 63 and nut 65.

A hydraulic cylinder 71 is pivotably mounted at one end to member 23 by any convention means such as by a nut and bolt assembly. The hydraulic cylinder 71 has a cylinder rod 75 which contains a radially extending hole 76. A generally tubular member 77 is placed around the rod 75 to align a hole 78 extending transversely in the tubular member to the hole 76 of the cylinder rod 75. A brace 79 is fixably mounted by any conventional means such as welding to the tubular member 77 such that a hole 80 in the brace is aligned with the holes 76 and 78. A spacer 81 is passed through the slot 27 in the top surface of the frame 21 and the holes 78 and 80 to rest abuttingly at one end against the tubular member 77 about the hole 78. A washer 83 is placed around the spacer 81 to rest on the top side of the surface 25. A pulley 85 is placed around the spacer 81 following the washer 83. A second washer 87 is placed around the spacer 81 above the pulley 85.

Referring again to FIGS. 1 and 2, a cable 89 and 91 having one of their respective ends clamped together by clamps 93 and 95 such that a looped portion is formed between the clamps 93 and 95. A bolt 99 is passed through the cylinder arm 75, tubular member 77, brace 79, spacer 81, washer 83, pulley 85 and washer 87, and between the looped portion of the clamped cables and a washer 101. A nut 103 is then secured to the stem of bolt 99 maintaining the alignment.

Cable 89 extending from the clamp 93 travels to and is looped around the pulley 51 there from journeying to the pulley 84 and looped therearound back to the pulley 51 and looped therearound journeying therefrom to the chut 15 and fixably mounted to one side of the cable. That portion of cable 91 extending from clamp 95 in like manner extends to the first pulley 61 and is looped therearound back to the pulley 85 and looped therearound journeying back to pulley 61 looped therearound and thereafter fixably attached to the other side of the chute 15. It is appreciated that the extension or retraction of the hydraulic cylinder 71 causes the relative lengths of cable to adjust and therefore providing sufficient force upon the chut 15 to accomplish its rotation. A shield 102 (shown in part) can be readily mounted to the bolts 33 and 31 to protect the assembly 19.

Figure 4:
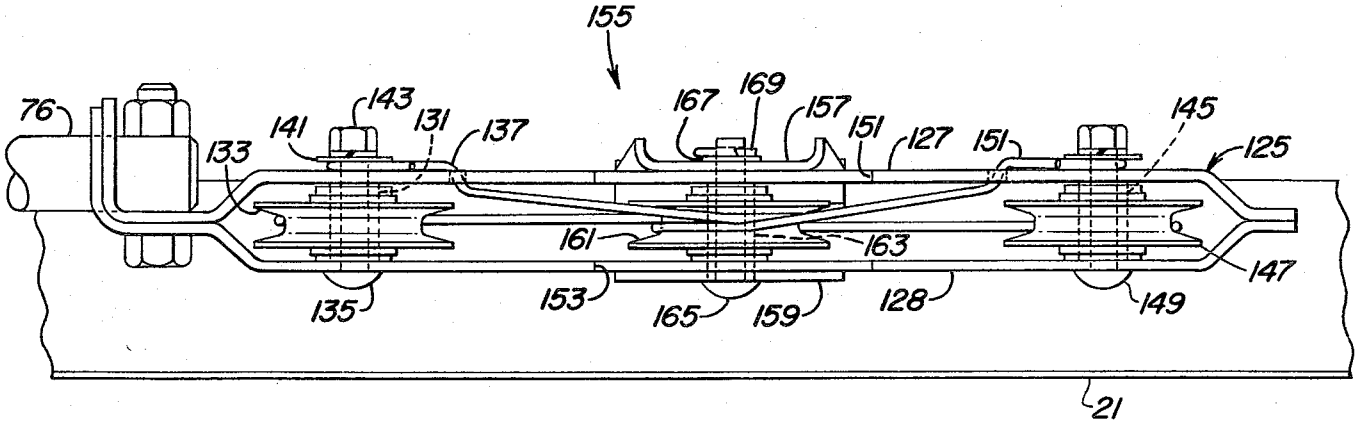
FIG. 4 is an elevated view of an alternative embodiment in accordance with the present invention.

Referring now to FIG. 4, an alternative embodiment of a hydraulic chute rotation assembly, in accordance with the present invention includes the frame 21 without a top surface 25. The hydraulic cylinder 71 is again pivotally mounted to the member 23 by any conventional means. A first brace 125 is fixably mounted to the hydraulic cylinder arm 75. The brace 125 includes two parallel extending arms 127 and 128. Each parallel extending arm has longitudinally aligned slots 151 and 153, respectively. Placed in between the arms 127 and 128 is a first spacer 131 carrying a pulley 133. A bolt 135 is passed through the parrallel extending arms 127 and 128 central to the spacer 131 followed by a washer 141 and engaging nut 143 atop the upper parallel arm 127. In like manner, a spacer 145 carries a pulley 147 having a bolt 149 passed centrally through the spacer 145 and parallel extending arms 127 and 128. Atop the upper arm 127 is a washer 152 and nut 153. Each pulley 133 and 147 is aligned such that the slots 141 and 153 are located between the pulleys 133 and 147.

A second brace assembly 155 includes an upper member 157 and lower member 159 located generally such that the upper member 157 is above the slot 151 in an abutting relationship to arm 127 and the lower member 159 is below the slot 153 abutting arm 128. The members 157 and 159 are fixably mounted by any conventional means to the frame 121. A pulley 161 placed around a spacer 163 which is located between the parallel arms 127 and 128 of brace 125 such that a pin 165 can extend centrally through the spacer 163 and slots 151 and 153 having a head abutting the lower mounting member 159. Atop the upper member 157 is placed a washer 167 and pin clamp 169 to restrainably hold the pin 165. The first cable 137 is fixably mounted at one end between the upper brace 127 and washer 143 and extends through an aperture in the upper brace 127 to be looped around the pulley 161 leading to the pulley 121 and therefrom fixably mounted at the other end to one side of the chute 15. A second cable 151 is fixably mounted at one end in like manner between the washer 152 and nut 153 to extend through an aperture in the upper brace member and to be looped around the pulley 161. The cable 155 then extends from the pulley 161 to be looped around the pulley 147 and therefrom journeying to the chute 15 whereupon the other end is fixably mounted to the other side of the chute 15. This allows the movement of the hydraulic cylinder 129 to alter the relative lengths of the cable 137 and 151 with respect to the pulleys 133, 147 and 161 causing the chute 15 to rotate.

The sensitivity of the chute rotation assembly either in the preferred embodiment or alternative embodiment is a function of the number of times the cables are looped around respective pulleys.

I claim:

1. In combination with a snowblower having a housing open along one side to receive snow and means for impelling said snow from said housing and a chute rotatably mounted to said housing for directing said impelled snow, a hydraulic chute rotation assembly comprising: a frame having a top surface containing a slot, a first and second pulley rotatably mounted to said top surface of said frame in fixed location having a longitudinally extending slot located generally between said pulleys, a hydraulic cylinder fixably mounted to said frame, said cylinder having a displacable cylinder arm, a third pulley rotatably mounted to said cylinder arm and located generally between said first and second pulleys above said slot, said third pulley being mounted to said cylinder arm such that motion of said cylinder arm causes said third pulley to travel in a path defined by said slot, and said frame being fixably mounted to said housing, cable means for communicating said chute and said hydraulic cylinder including a cable communicating with said pulleys such that displacement of said third pulley by said hydraulic cylinder alters the relative lengths of said cable relative to said pulleys resulting in rotation of said chute.

2. A combination as recited in claim 1 wherein said cable means comprises a cable fixably mounted at one end to one side of said chute extending therefrom to and looped around said first pulley and therefrom to and looped around said third pulley, and therefrom back to and looped around said first pulley and therefrom to and looped around said second pulley and therefrom to and looped around said third pulley and therefrom to and looped around said second pulley and therefrom to another side of said chute thereupon fixably mounted, whereby displacement of said third pulley affects the relative lengths of said cable with respect to said pulleys to cause said chute to rotate.

3. In combination with a snowblower having a housing open along one side to receive snow and means for impelling said snow from said housing and a chute rotatably mounted on said housing for directing said impelled snow, a hydraulic chute rotation assembly comprising: a frame fixably mounted to said housing, a hydraulic cylinder fixably mounted to said frame said hydraulic cylinder including a cylinder arm, a first and second pulley, a first brace fixably mounted to said cylinder arm, said first and second pulleys being rotatably mounted to said first brace in spaced apart alignment, a second brace fixably mounted to said frame and slidable restraining said first brace, a third pulley rotatably mounted to said second brace located generally betwen said first and second pulleys, cable means for communicating said chute to said pulleys including a cable communicating with said pulleys such that displacement of said second and third pulleys by said hydraulic cylinder alters the relative lengths of said cable with respect to said pulleys resulting in rotation of said chute.

4. A combination as recited in claim 3 wherein cable means comprises a first cable fixably mounted at one end to said first brace at a point opposite said first pulley journeying therefrom to said second pulley and around said second pulley back to and looped around said first pulley and fixably mounted to said chute at the other end, a second cable fixably mounted at one end to said first brace at a point adjacent to said third pulley journeying therefrom and looped around said first pulley and back to said third pulley extending therefrom and fixably mounted to another side of said chute.

5. A combination as recited in claim 3 wherein said second brace includes guide means for directing the travel of said first brace.

* * * * *